United States Patent [19]

Schmidt

[11] 4,078,364

[45] Mar. 14, 1978

[54] DEVICE FOR FOLDING AND CLOSING GABLE-SHAPED FOLDING CLOSURES

[75] Inventor: Paul Schmidt, Dusseldorf, Germany

[73] Assignee: Jagenberg-Werke, Dusseldorf, Germany

[21] Appl. No.: 670,038

[22] Filed: Mar. 24, 1976

[30] Foreign Application Priority Data

May 7, 1975 Germany ..... 2520400

[51] Int. Cl.[2] ..... B65B 7/16

[52] U.S. Cl. ..... 53/378; 53/375; 93/44.1 GT

[58] Field of Search ..... 53/351, 352, 375, 378, 53/379, 173, 373; 93/44 GT

[56] References Cited

U.S. PATENT DOCUMENTS

| | | | |
|---|---|---|---|
| 1,106,303 | 8/1914 | Hesser | 53/378 X |
| 1,235,146 | 7/1917 | Magrane | 53/351 X |
| 1,275,756 | 8/1918 | Rose | 53/378 |
| 2,015,061 | 9/1935 | Baughman | 29/215 |
| 3,347,017 | 10/1967 | Allen et al. | 53/375 X |
| 3,579,958 | 5/1971 | Hentges | 53/379 X |
| 3,755,986 | 9/1973 | Hodson | 53/378 |
| 3,890,765 | 6/1975 | Farfaglia et al. | 53/375 X |

*Primary Examiner*—Othell M. Simpson
*Assistant Examiner*—John Sipos
*Attorney, Agent, or Firm*—Burgess, Dinklage & Sprung

[57] ABSTRACT

In an apparatus for folding and closing a package having a gable-shaped folding closure having marginal areas forming a fillet seam, and including means for advancing the package past a working station, there is provided a pincer closing tool having jaws and handles, the tool advancing with the package. A wedge having two pairs of faces of different inclinations is forced downwardly to pivot the pincer jaws first to effect folding and then, under the greater force of the shallower inclination, pressing of the closure. A two-armed lever, one arm of which is connected to a toggle arm surrounded by a compression spring, controls the movement of the wedge. The pincers also move vertically toward the package during the closing operation.

5 Claims, 2 Drawing Figures

DEVICE FOR FOLDING AND CLOSING GABLE-SHAPED FOLDING CLOSURES

BACKGROUND

Figure 1:
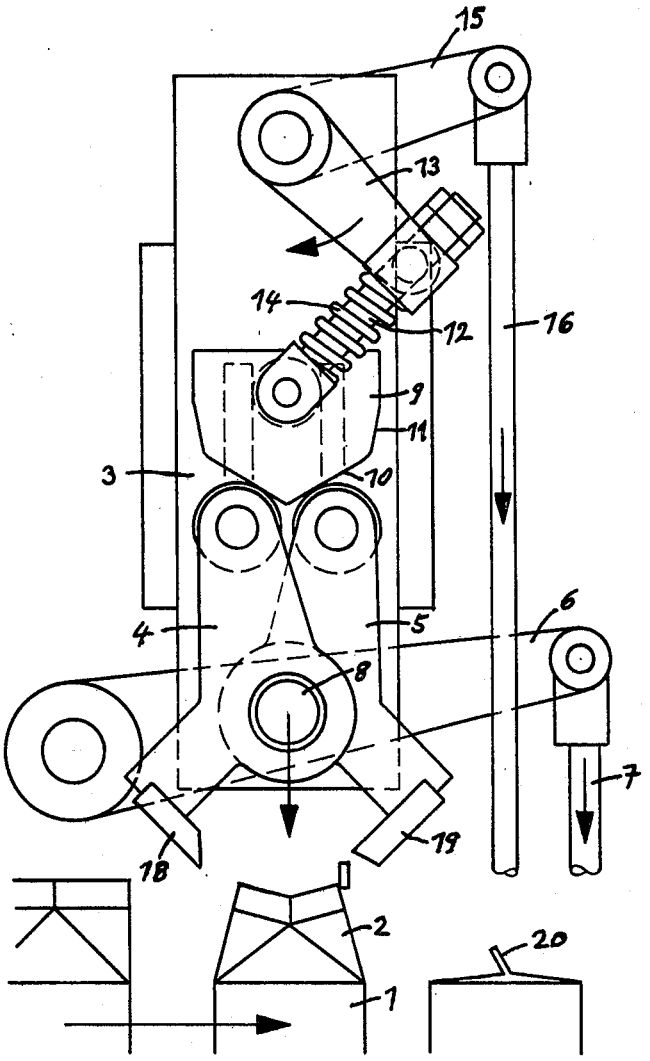

The invention relates to a device for the folding and closing of fillet-seamed, gable-shaped folding closures on packages by means of a tool mounted above the working station and acting externally on the confronting roof panels of the closure.

In one known device, the tool consists of a stationary jaw and a jaw pivotingly mounted on a lever arm. The movable jaw has but a short throw, and to enable the fillet seam of the gable-shaped folding closure to be pressed on this device, a shunt is placed ahead of the tool in the direction of transport of the packages, and moves the roof panels of the folding closure against one another to such an extent that the margins which form the fillet seam can be introduced into the gap between the jaws of the tool. It is disadvantageous in this device that two stations are required for the folding and closing operation, namely the shunt for folding the gable-shaped closures, and the jaws for the pressing of the fillet seam.

THE INVENTION

The invention is addressed to the problem of creating a device which will both fold the folding closure and press the fillet seam.

This problem is solved by the invention in a device of the initially described kind in that the tool, which is constructed as a pincer, advances toward the package during the roof panel folding procedure in such a manner that the paths of movement of the tool jaws approximate the paths of movement of the marginal areas forming the fillet seam.

The invention is based on the idea that a folding and closing (pressing) of the folding closure with a single tool would require the tool jaws to have a movement substantially following the paths of movement of the marginal areas of the folding closure, because only in this manner will both a precise folding and a clean pressing of the folding closure be possible. The solution consists essentially in superimposing on the arcuate path of the tool jaws a rectilinear movement in the direction of the package. In this manner it is possible to accomplish the task with a single tool and perform the operation at a single station.

A wedge which can engage the "handles" of the pincer-like tool is especially appropriate for its actuation. With a wedge it is possible in a simple manner to apply a force that will vary according to the length of the movement of the wedge as required for the folding phase and the pressing phase, by providing the wedge with two pairs of faces of different inclination, the pair of shallow inclination acting in the pressing phase.

Preferably, the wedge is connected by a toggle joint to a point that is in a fixed relationship to the fulcrum of the pincer, the said toggle joint being extendable for the purpose of forcing the wedge between the pincer arms. With a toggle joint of this kind a great force can be applied, especially in the pressing phase, as the toggle joint approaches its fully extended state. In order to apply a specific pressure to the fillet seam in the pressing phase, a buffer, in the form, for example, of an adjustable compression spring, can be provided in one arm of the toggle joint.

For the coordination of the superimposed movement of the wedge in relation to the pincer-like tool and of the tool holder and wedge in relation to the working point, adjustable cams are provided. It has proven to be desirable to provide a common drive for the wedge and tool holder, since this facilitates the coordination of the movements.

Figure 2:
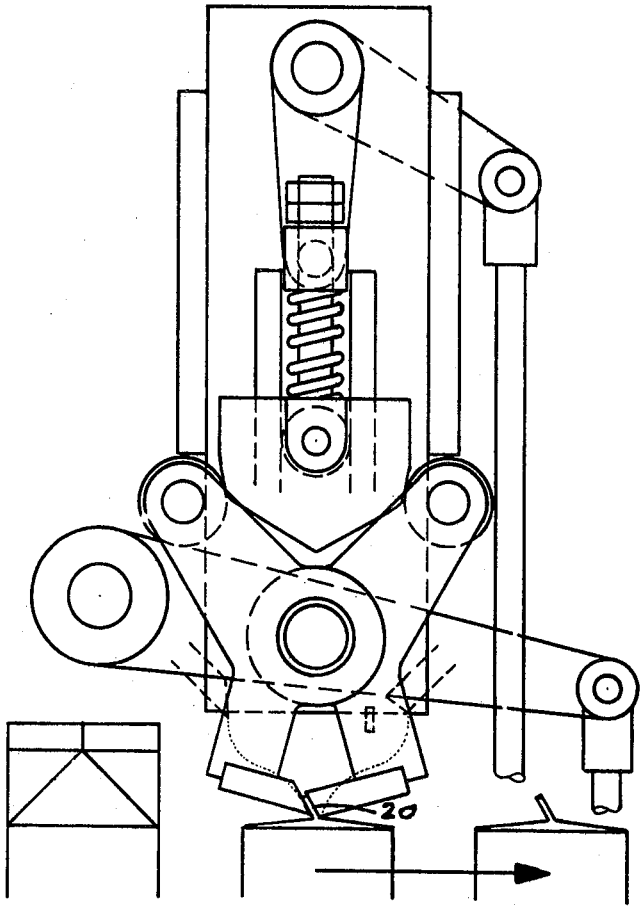

The invention will be further explained hereinbelow with the aid of a drawing representing one embodiment, in which FIG. 1 is a front elevational view of a device with the pincer open, and FIG. 2 is a view corresponding to FIG. 1 with the pincer closed.

Above the station for the closing of a package 1 having a folding closure 2 there is disposed a holder 3 for a pincer-like tool 4-5. The holder 3 is engaged by a lever 6 which can be raised and lowered, and which is operated by means of a connecting rod 7 whose movement is controlled by a cam. A wedge 9 is displaceably mounted on the holder 3 above the fulcrum 8 of the pincer-like tool 4-5. The wedge 9 has a pair of steep faces 10 and a pair of shallow faces 11. The wedge 9 is engaged by a toggle joint 12-13 whose other extremity is jointed to the holder 3. A buffer in the form of a compression spring 14 is provided on part 12 of the toggle joint. A lever 15 is affixed to part 13 of the toggle joint and can be moved up and down by a second connecting rod 16. The second connecting rod 16 can be driven axially also by a cam. Both cams are driven synchronously by a common drive, which is not shown, so that the movements of the holder 3 and of the pincer-like tool 4-5 are coordinated such that the jaws 18-19 of the tool describe the path indicated by the dotted lines, thereby approximating the path of movement of the fillet seam 20 of the gable-like closure 2.

For the first phase of the movement of the jaws 18-19, i.e., for the folding procedure, the steep pair of wedge faces 10 is responsible, while the wedge faces 11 are responsible for the pressing phase. The steep wedge faces 10 produce a great swinging movement of the jaws 18 and 19 for a short movement of the wedge 9, while the shallow wedge faces 11 produce a minimal swinging movement of the jaws 18 and 19 for a great movement of the wedge. Full provision is thus made for the forces that are required during the individual phases of movement. Also, during the pressing phase involving the action of wedge faces 11, the toggle joint 12-13 approaches its outstretched position and therefore can act with great power on the wedge 9, so that a high pressing force can be achieved by the jaws 18-19.

It will be appreciated that the instant specification and examples are set forth by way of illustration and not limitation, and that various modifications and changes may be made without departing from the spirit and scope of the present invention.

What is claimed is:

1. In an apparatus for folding and closing a package having a gable-shaped folding closure having marginal areas forming a fillet seam, and including means for advancing the package past a working station, and a tool mounted above the working station and acting externally on the opposed roof panels of the closure, the improvement which comprises means for advancing the tool vertically towards and away from the package, the tool being constructed as a pair of pincers having handles and jaws, and means for moving the jaws along paths approximating the paths of movement of the marginal areas forming the fillet seam simultaneously with the vertical movement thereof towards the package to effect both the folding of the closure and the sealing of the fillet seam said means for moving the jaws including a displaceable wedge operatively engaging the handles of the tool for pivotal displacement of the pincer jaws relative to one another.

2. An apparatus according to claim 1, wherein the wedge has two pairs of wedge faces respectively operatively engaging one of the pincer handles, the two faces having different angles of inclination, the shallower angled face being active during the pressing operation after folding has been effected.

3. An apparatus according to claim 1, including a pair of lever arms pivotable about a fulcrum in fixed angular relation relative to one another, the first of the lever arms being pivotally connected to a vertical drive member for the wedge, whereby when the second of the lever arms is pivoted about the fulcrum the first lever arm also is pivoted and displaces the wedge vertically through the intermediary vertical drive member.

4. An apparatus according to claim 3, including a compression spring operatively connected with the vertical drive member so as to force the wedge downwardly during a folding and closing operation.

5. An apparatus according to claim 4, including means for lowering the tool relative to the package simultaneously with pivoting of the jaws, the wedge having two pairs of wedge faces respectively operatively engaging one of the pincer handles, the two faces having different angles of inclination, the shallower angled face being active during the pressing operation after folding has been effected.

* * * * *